US006648770B1

(12) United States Patent
Snyder

(10) Patent No.: US 6,648,770 B1
(45) Date of Patent: Nov. 18, 2003

(54) TRAINING GOLF IRON

(76) Inventor: John M. Snyder, 7622 Aldrich Cir., Brooklyn Park, MN (US) 55444

( * ) Notice: Subject to any disclaimer, the term of this patent is extended or adjusted under 35 U.S.C. 154(b) by 1 day.

(21) Appl. No.: 09/697,864

(22) Filed: Oct. 27, 2000

Related U.S. Application Data

(63) Continuation-in-part of application No. 29/106,275, filed on Jun. 10, 1999, now Pat. No. Des. 433,086.

(51) Int. Cl.[7] ..... A63B 69/36

(52) U.S. Cl. ..... 473/238; 473/237; 473/201; 473/409

(58) Field of Search ..... 473/201, 291, 473/238, 237, 409; 273/81

(56) References Cited

U.S. PATENT DOCUMENTS

| | | | | | |
|---|---|---|---|---|---|
| D30,708 | S | * | 5/1899 | Griffith | 111/62 |
| 1,930,204 | A | | 10/1933 | Judd et al. | |
| D93,756 | S | | 11/1934 | Barnhart | |
| 2,150,737 | A | | 3/1939 | Chittick | |
| 2,628,100 | A | * | 2/1953 | Beebe | 273/81 |
| D215,314 | S | | 9/1969 | Jackson | |
| D246,003 | S | | 10/1977 | Shimada | |
| 4,327,916 | A | * | 5/1982 | Shiratori | 473/238 |
| 4,511,147 | A | * | 4/1985 | Olsen | 473/203 |
| D365,131 | S | | 12/1995 | Edwards et al. | |
| 5,582,407 | A | | 12/1996 | Sorenson | |
| D378,771 | S | | 4/1997 | Antonious | |
| D380,802 | S | | 7/1997 | Franks | |
| D395,477 | S | | 6/1998 | Vela | |
| 5,879,164 | A | | 3/1999 | De Jesus | |
| 5,890,971 | A | * | 4/1999 | Shiraishi | 473/291 |
| 5,890,977 | A | * | 4/1999 | Taylor | 473/409 |
| 6,022,278 | A | * | 2/2000 | Vela | 473/201 |

* cited by examiner

*Primary Examiner*—Paul T. Sewell
*Assistant Examiner*—Tom P Duong

(57) ABSTRACT

A swing training golf iron has a solid metal linear shaft attached to an iron golf head and a hand grip. The side of the shaft facing the iron golf head has linear indicia located between the head and grip to provide visual orientation of the angular orientation of the golf head relative to the longitudinal axis of the shaft. The hand grip has a pair of projections for locating the golfer's hand son the grip. Each projection has a V-shaped indicia to aid in the angular orientation of the iron golf head.

8 Claims, 2 Drawing Sheets

TRAINING GOLF IRON

CROSS REFERENCE TO RELATED APPLICATION

This application is a continuation-in-part of U.S. patent application Ser. No. 29/106,275 Filed Jun. 10, 1999 Now U.S. Pat. No. Des. 433,086

FIELD OF THE INVENTION

The invention relates to golf swing training equipment for developing muscle coordination and memory to improve a golfer's golf club swing. The training equipment is a golf iron having a grip and linear indicia providing the golfer with visual information of the angular orientation of the golf club iron head.

BACKGROUND OF THE INVENTION

Skeletal human muscle is the most abundant tissue in the human body and also one of the most adaptable. Vigorous training over a period of time can double or triple a muscle's size. Disuse of a muscle for a period of two weeks can shrink the unused muscle by 20 percent. Physical training and exercises develop muscle coordination and memory for repetitive movements. Golfers practice golf club swings at driving ranges and practice on putting greens with conventional golf clubs and putters. The golf clubs do not have additional weight so that in use they do not communicate to the arms, shoulder, body and leg muscles of the golfer to relieve muscle tension and habits and develop muscle memory conducive to an improved golf club swing.

B. M. Beebe in U.S. Pat. No. 2,628,100 discloses a golf club having a tapered linear shaft joined to a club head. A golf grip telescoped over the upper end of the shaft has upper and lower prominences 27 and 28. In use the prominences 27 and 28 are located between the thumb and index fingers of the hands of the golfer.

J. W. Sorenson in U.S. Pat. No. 5,582,407 discloses a golf swing trainer having a solid steel shaft fitted with a standard golf club grip. A rubber tip is connected to the lower or outer end of the shaft. A golf club head can be used instead of the rubber tip for visual or psychological reasons. The top of the shaft bears a straight line indicia as a club face reference. The center of gravity of the trainer is centered at a midpoint of the longitudinal axis of the shaft. Repeated swings of the trainer establishes a muscle memory of the path of a correct golf swing.

C. L. De Jesus discloses in U.S. Pat. No. 5,879,164 a golf club having a shaft attached to a cylindrical handle and a head equipped with a visible elongated angle guide. The angle guide is located in an predetermined position with respect to the club face whereby the golfer is able to align the angle guide and the club face with respect to a fixed visible line marker on the ground and the ground surface before the swing, during the swing, and before and after the club head strikes the ball.

SUMMARY OF THE INVENTION

The golf club swing trainer of the invention is used by golfers to strengthen and improve the tone of muscles in a golfers body, arms, legs and shoulders and ingrain muscle memory for an improved golf club swing. The trainer is also used for practice swings to relax and warm up the muscles of a golfer. The trainer has an elongated linear shaft having a longitudinal axis, an upper end portion and lower end portion. The shaft can be a solid metal rod, such as a steel rod. An iron golf head having an upwardly directed neck is connected to the lower end portion of the shaft. A hand grip of flexible rubber-like material fits on the upper end portion of the shaft. The center of gravity of the trainer is below and lateral of the center of the shaft. Longitudinal indicia, such as a pair of spaced parallel lines, located on the side of the shaft facing the iron golf head provide visual information to the golfer as to the angular orientation of the iron golf head relative to the longitudinal axis of the shaft. The grip has outwardly directed projections providing hand locators for holding the grip. The projections having V-shaped indicia to aid in the visual orientation of the iron golf head. The projections comprise a first wedge shaped projection generally aligned with the indicia on the shaft and a second wedge shaped projection spaced upwardly and circumferentially from the first projection. The V-shaped indicia are located on the first and second wedge shaped projections.

DESCRIPTION OF THE INVENTION

Figures 1, 2, 6, 7:
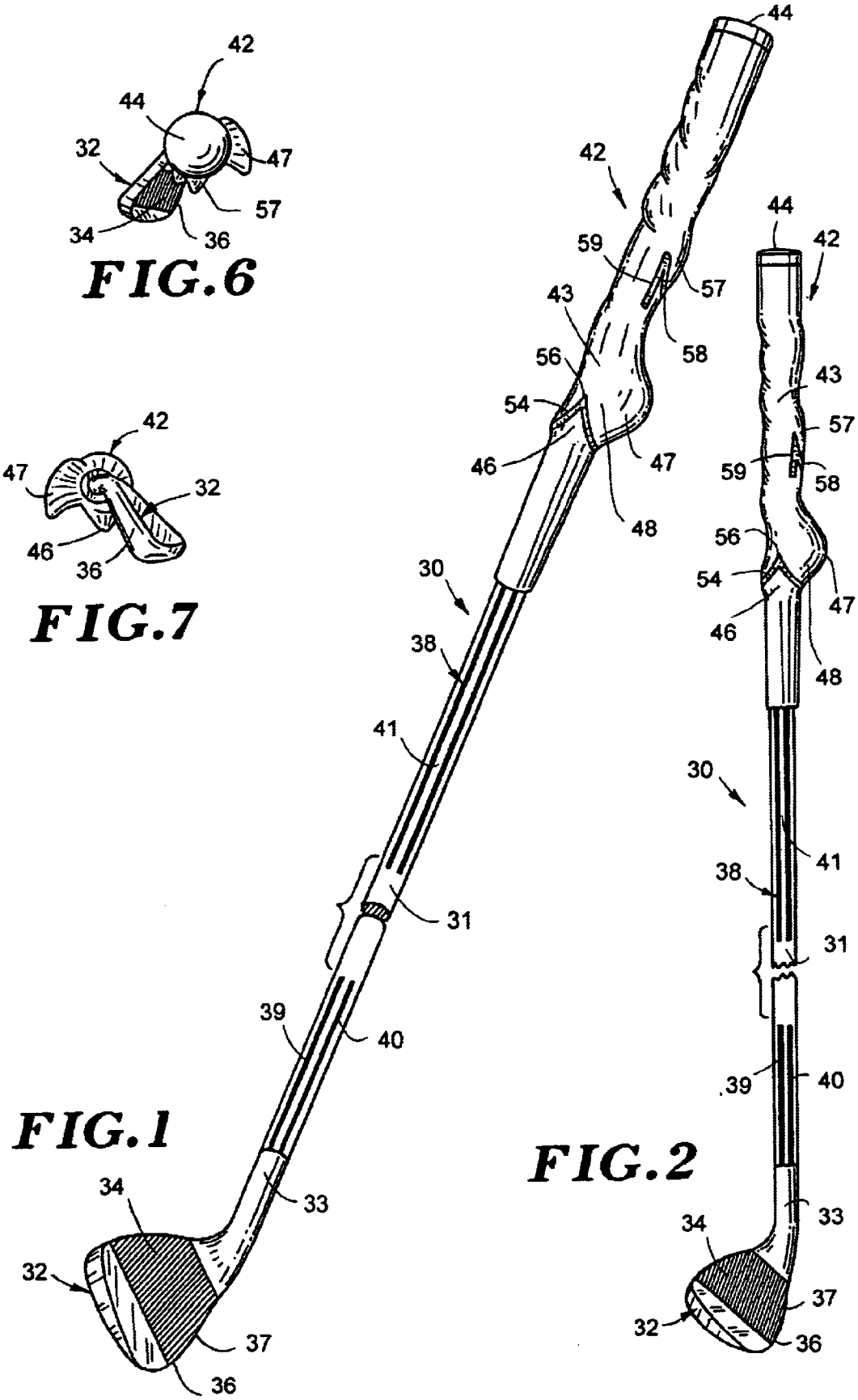
FIG. 1 is a foreshortened perspective view of the TRAINING GOLF IRON design of my new design.
FIG. 2 is a foreshortened front elevational view thereof
FIG. 6 is a top plan view thereof.
FIG. 7 is a bottom plan view thereof.
Figure 3:
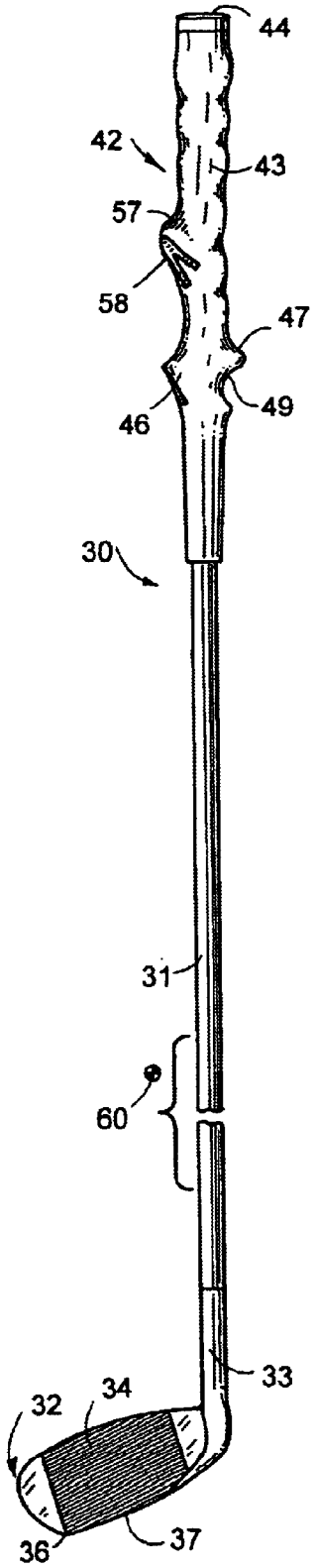
FIG. 3 is a foreshortened side elevational view of the right side thereof.
Figure 4:
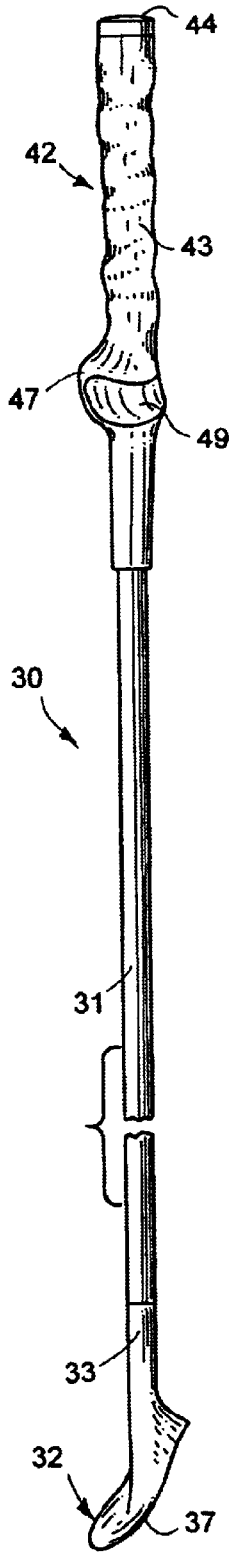
FIG. 4 is a foreshortened rear elevational view thereof.
Figure 5:
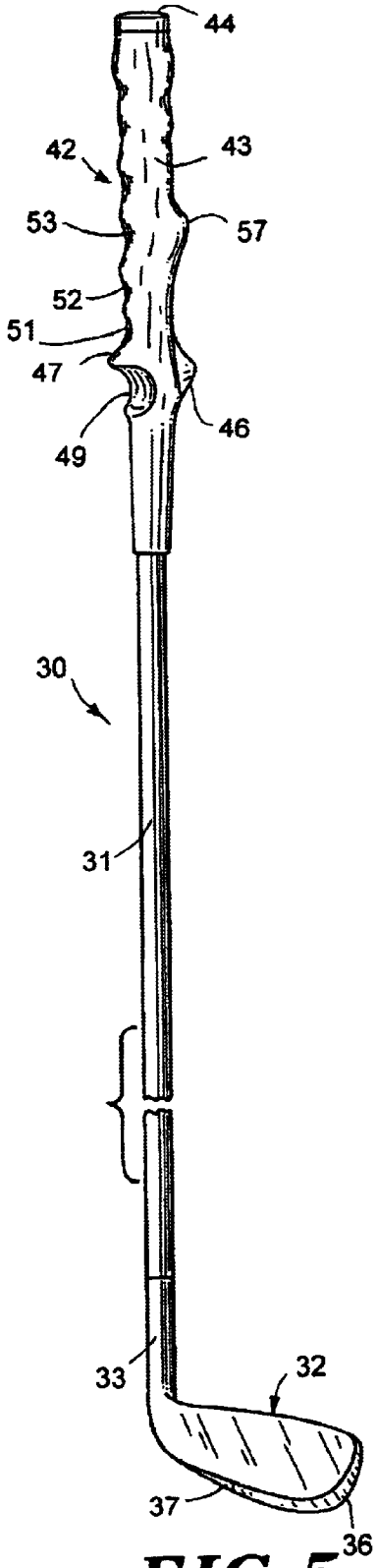
FIG. 5 is a foreshortened side elevational view of the left side thereof.

The training golf iron 30, shown in FIGS. 1 to 7, aligns the golfer's hands on a hand grip with the iron head that develops muscle coordination needed to produce an effective golf swing. Training golf iron 30 has an elongated cylindrical shaft 31 having a lower end connected to golf iron head 32. Shaft 31 is a solid metal rod having a uniform diameter throughout its length. The metal of shaft 31 is a rigid steel cylindrical rod. Other types of metal can be used for shaft 31. Iron 32 has a tubular neck 33 having a cylindrical bore accommodating the lower end of shaft 31. Bonding material and adhesives are used to secure neck 33 to shaft 31. Other types of fasteners, such as solder and welds can be used to connect neck 33 to shaft 31. Golf iron head 32 has an upwardly and rearwardly front face 34. An shown in FIGS. 2 and 3, the middle section of face 34 has a plurality of parallel horizontal grooves between the top edge 35 and bottom edge 36 thereof. Bottom edge 36 has a mid-point 37 located in the axial plane of the longitudinal axis of shaft 31. Visual indicia 38, comprising linear parallel lines 39 and 41, are located on the outside side of shaft 31. The linear space 41 between the lines 39 and 41 is located in the axial plane of the longitudinal axis of shaft 31 and mid-point 37 of the bottom edge 36 of head 32. The visual indicia on the outside side of shaft 31 can be one or more broken lines or line segments or a linear series of dots or circles. Examples of these visual indicia on the outside side of the shaft of a golf iron are disclosed by J. M. Snyder in U.S. Pat. No. Des. 433,086, which is incorporated herein by reference.

A hand grip, indicated generally at 42, is attached to the upper end of shaft 31. Grip 42 has a blind bore that accommodates the upper end of shaft 31. Bonding materials and adhesives are used to secure grip 42 to shaft 31. Other types of fasteners can be used to connect grip 42 to shaft 31.

The center of gravity 60 of the combined shaft, iron golf head and grip is below the longitudinal center of shaft 31 and laterally away from the shaft. Grip 42 comprises an elongated body 43 having a rounded upper end cap 44. Body 43 is a one piece flexible rubber or rubber-like member. The lower portion of the inside of body 43 has an outwardly directed first projection 46 having upwardly converging side walls. A second projection 47 is circumferentially spaced about 90 degrees from projection 46. A concave groove or recess 48 located between projections 46 and 47 accommodates the thumb of the right hand of a golfer. The index or trigger finger of the golfer curves around the back side of projection 46 and extends into curved concave groove 49. The third, fourth and fifth fingers of the right hand fit into shallow grooves 51, 52 and 53, shown in FIG. 5. An upwardly extended V-shaped indicia 54 is located on the first projection 46. The apex 56 of V-shaped indicia 54 is located in longitudinal alignment with the longitudinal space 41 between indicia lines 39 and 40, as shown in FIGS. 1 and 2, and mid portion 37 of the lower edge 36 of iron head 34. The V-shaped indicia 54 and indicia lines 39 and 40 provide the golfer with visual information of the angular orientation of iron head 34. Body 43 has a third upwardly tapered projection 57 generally longitudinally aligned with recess 48 between projections 46 and 47. The thumb of the left hand engages the back side of projection 57. Projection 57 is located between the left thumb and index finger to retain the angular orientation of iron head 32 relative to the longitudinal axis of shaft 31. The outer surface of projection 57 has an upwardly converging V-shaped indicia 58 having a longitudinal line 59 extended parallel to the longitudinal axis of shaft 31 and longitudinal space 41. Line 59 provides the golfer with additional visual longitudinal alignment with space 41 and rotational orientation of iron head 32. The fingers of the left hand of the golfer wrap around the upper end of body 43 to complete the grip of the left hand of body 41.

An example of a training golf iron has an overall length of 35 inches and a weight of 3.5 pounds. The center of gravity 60 is below the longitudinal center of shaft 31 and laterally away from the shaft. The shaft 31 is a steel cylindrical rod having a diameter of ⅝ inch. The iron head 32 is a No. 8 iron with the front face 34 having a slope of 40 degrees from a vertical plane extended along the longitudinal axis of shaft 31. The neck 33 of iron head 32 surrounds the lower end of shaft 31 and is secured thereto. Grip 42 is a flexible rubber sleeve or body having a length of 10 inches. The body has a cylindrical blind bore that accommodates the upper end of shaft 31. The grip 42 is secured to the upper end of shaft 31. Alternative training golf irons have overall lengths of 27 and 30 inches and weights of 1.5 and 2.5 pounds.

The training golf iron 30 is used to gradually strengthen and improve the tone of the golf muscle group and ingrain proper muscle memory for a swing of a golf club. The golfer's weight shift, wrist action, tempo, take-away, foot work, balance and other major components of a solid and repeatable golf swing is enhanced with use of training golf iron 30. The training golf iron 30 when used daily to take 15 to 20 practice swings achieves these advantageous results.

Training golf iron 30 is initially used by the left hand putting the first V-shaped projection 57 of grip 42 in between the left thumb and index finger the right index finger or trigger finger is then placed in groove 49 at the bottom of the grip 42. The remaining right and left hand fingers are then located in separate molded areas of body 43. The golfer stands up tall keeping the left arm straight and bending slightly at the hips. The feet of the golfer are spread apart as wide as the shoulders. The swing is commenced by keeping the golfer's head in a stationary position and turning the shoulders back or in a swiveling motion. When the golfer feels a restriction on the back turn, a correct shoulder turn for a back swing is achieved. With the left arm straight for right-handed golfers or the right arm straight for left-handed golfers the swing trainer 30 is started to move down with the transfer of weight from the right foot or left foot letting the centrifugal force of the swing trainer 30 pull the arms and shoulders through to impact to a full follow through. The centrifugal force of the swing trainer 30 will pull the golfer to the left foot creating a full finish.

The golf club swing trainer herein described is one embodiment of the trainer. Changes in structure, grip, golf iron head, indicia, materials and arrangement of structures may be made by one skilled in the art without departing from the invention.

I claim:

1. A golf swing trainer comprising: an elongated linear straight shaft having a single longitudinal axis, an upper end portion, and a lower end portion, an iron golf head secured to the lower end of the shaft, said head having an upwardly and rearwardly inclined front face and a bottom edge having a middle section, a hand grip mounted on the upper end portion of the shaft, said trainer having a center of gravity located below the longitudinal center of the shaft, a pair of circumferentially spaced parallel lines indicia on the side of the shaft facing the iron golf head located between the head and grip, said space between the lines indicia being aligned with the middle section of the bottom edge of the head, said grip having a first projection adapted to be located between the thumb and the index finger of one hand of a golfer, a second projection axially spaced from the first projection adapted to be located between the thumb and the index finger of the other hand of the golfer, said first projection having a generally upwardly and outwardly directed wedge shape with an apex longitudinally aligned with the longitudinal axis of the shaft and the space between the lines indicia on the side of the shaft, said second projection being circumferentially spaced about 90 degrees with respect to the first projection, and a third projection axially spaced from the first and second projections, said third projection having an outer surface, and an upwardly converging V-shaped indicia on said outer surface of the third projection, said V-shaped indicia having a longitudinal line extended parallel to the longitudinal axis of the shaft.

2. The trainer of claim 1 wherein: the shaft is a solid metal rod.

3. The trainer of claim 1 wherein: the iron golf head has a front face inclined upwardly and rearwardly at an angle between 5 to 60 degrees relative to a vertical plane extended through the longitudinal axis of the shaft.

4. The trainer of claim 1 including: a V-shaped indicia on the first projection, said indicia having an apex aligned with the longitudinal axis of the shaft.

5. A golf swing trainer comprising: an elongated linear straight shaft having a single longitudinal axis, an upper end portion, and a lower end portion, a golf head secured to the lower end portion of the shaft, a hand grip mounted on the upper end portion of the shaft, said head having an upwardly and rearwardly inclined front face and a bottom edge having a middle section, said trainer having a center of gravity located below the longitudinal center of the shaft and laterally of the shaft, a longitudinal indicia having at least one longitudinal line located parallel to the longitudinal axis of the shaft on the side of the shaft facing the golf head located between the golf head and grip providing a visual angular orientation of the golf head relative to the longitudinal axis of the shaft, said line being generally aligned with the middle section of the bottom edge of the head, said grip including a first projection having a generally upwardly and outwardly directed wedge shape with an apex longitudinally aligned with the longitudinal axis of the shaft and generally with the longitudinal line on the shaft, a second projection circumferentially spaced with respect to the first projection, and a third projection axially spaced about 90 degrees from the first and second projections, said third projection having an outer surface, and an upwardly converging V-shaped indicia on said outer surface of the third projection, said V-shaped indicia having a longitudinal line extended parallel to the longitudinal axis of the shaft to facilitate holding of the trainer and angular orientation of the golf head.

6. The trainer of claim 5 wherein: the shaft is a solid metal rod.

7. The trainer of claim 5 wherein: the golf head is an iron head having an upwardly and rearwardly inclined front face.

8. The trainer of claim 7 wherein: the front face of the iron head is inclined at an angle between 5 to 60 degrees relative to a vertical plane extended through the longitudinal axis of the shaft.

* * * * *